US009981172B2

(12) United States Patent
Massey et al.

(10) Patent No.: US 9,981,172 B2
(45) Date of Patent: May 29, 2018

(54) ATHLETIC COACHING SYSTEM AND METHOD

(71) Applicant: Future1s, LLC, Mobile, AL (US)

(72) Inventors: Trent S. Massey, Mobile, AL (US); Lawrence Gustin Smith, Mobile, AL (US)

(73) Assignee: Future1s, LLC, Mobile, AL (US)

( * ) Notice: Subject to any disclaimer, the term of this patent is extended or adjusted under 35 U.S.C. 154(b) by 0 days. days.

(21) Appl. No.: 15/613,169

(22) Filed: Jun. 3, 2017

(65) Prior Publication Data

US 2017/0348574 A1 Dec. 7, 2017

Related U.S. Application Data

(60) Provisional application No. 62/345,638, filed on Jun. 3, 2016.

(51) Int. Cl.

| | |
|---|---|
| ***A63B 69/36*** | (2006.01) |
| ***A41D 1/04*** | (2006.01) |
| ***A63B 69/00*** | (2006.01) |
| ***A41D 27/00*** | (2006.01) |
| ***A63B 71/06*** | (2006.01) |

(52) U.S. Cl.

CPC ..... *A63B 69/00* (2013.01); *A41D 1/04* (2013.01); *A41D 27/00* (2013.01); *A63B 69/002* (2013.01); *A63B 69/0024* (2013.01); *A63B 69/0071* (2013.01); *A63B 71/0622* (2013.01); *A41D 2600/10* (2013.01); *A63B 2071/0602* (2013.01); *A63B 2071/0661* (2013.01); *A63B 2071/0694* (2013.01); *A63B 2209/10* (2013.01)

(58) Field of Classification Search

USPC .. 2/69, 75, 77, 80, 106, 122, 244, 246, 247, 2/248, 249, 250, 251, 253, 265, 912; 473/409

See application file for complete search history.

(56) References Cited

U.S. PATENT DOCUMENTS 2,647,261 A * 8/1953 Rassner ..... A41D 1/04 2/115
4,277,848 A * 7/1981 Boehland ..... A41D 1/04 2/115
5,581,815 A * 12/1996 Hans ..... A41D 13/0015 2/115

(Continued)

*Primary Examiner* — Nini Legesse
(74) *Attorney, Agent, or Firm* — AdamsIP, LLC; Stephen Thompson; J. Hunter Adams

(57) ABSTRACT

An athletic coaching method and jersey system are provided. The method utilizes jerseys with securing elements attached thereto. Number panels having specific player numbers are secured to the jerseys for use during practice. Scout team players wear the jerseys during practice. Each scout team player has a different number to represent the jersey number of a player on an opposing team in an upcoming game. The method allows coaches to more realistically simulate a game against an opposing team in practice. When the opposing team changes for the next game, each scout team player can continue to wear the same jersey but change the jersey number by switching number panels to represent a different player on the team of the next opponent. Thus, jersey numbers can be changed so that a game can be simulated for any opponent.

8 Claims, 8 Drawing Sheets

(56) References Cited

U.S. PATENT DOCUMENTS

| | | | | | |
|---|---|---|---|---|---|
| 5,694,651 | A * | 12/1997 | Thomas | A41D 13/0015 | 2/115 |
| 5,957,692 | A * | 9/1999 | McCracken | G09B 19/00 | 2/49.1 |
| 6,185,746 | B1 * | 2/2001 | Scott | A41D 13/0015 | 2/115 |
| 6,782,554 | B1 * | 8/2004 | Froehlich | A41D 27/08 | 2/115 |
| 7,571,495 | B2 * | 8/2009 | Emeth | A41D 27/08 | 2/115 |
| 7,765,618 | B2 * | 8/2010 | Egglesfield | A41D 1/04 | 2/244 |
| 2011/0047669 | A1 * | 3/2011 | Carr | A41D 27/08 | 2/122 |

* cited by examiner

ATHLETIC COACHING SYSTEM AND METHOD

CROSS REFERENCES

This application claims the benefit of U.S. Provisional Application No. 62/345,638, filed on Jun. 3, 2016, which application is incorporated herein by reference.

FIELD OF THE INVENTION

A preferred embodiment of the present invention refers to an athletic coaching system and method.

BACKGROUND

Many athletic teams practice in preparation for an upcoming game against an opposing team. For example, it is quite common for football players to review and study game film of an opposing team a week or more before a football game. During preparation, it is common to practice for an upcoming game by running plays in which a scout team opposes a first-string team. The first-string team generally comprises the starting players on the team. These players generally play in the game for a significant portion of game time, if not for the entire game. A scout team is a group of players that are part of an athletic team that are generally not starting players. During practice for an upcoming game, scout team players attempt to emulate the play style of the opponent based on scouting reports and/or game tape of the opposing team. Individual scout players may also attempt to emulate individual players on the opposing team that play the same position on their respective teams and/or have similar athletic abilities as the scout player emulating the opposing team player. This allows the first-string team to practice for the opposing team by practicing against the scout team, which helps the first-string team to anticipate the opposing team's play calls on offense and defense. This also allows the first-string team to practice for individual players on the opposing team by practicing against a player having similar athletic abilities.

Because the scout team opposes the first-string team during practice, it is preferable for the scout team to emulate the opposing team as realistically as possible. To do so, it is best if the scout team can emulate the various plays and packages each opposing team presents in a game-time setting. Generally, alerting the first-string team players that a particular player on the scout team is emulating a certain player on a particular play accomplishes this task.

When playing a game against an opposing team, any individual player on the opposing team can be identified by the number on the player's jersey. However, when practicing for the opposing team, scout team players typically do not wear jerseys with numbers. The primary reason is that the opposing team changes from game to game, and consequently the player numbers of the players that the scout team is emulating also change from game to game. Instead, current practice is for scout team players to differentiate themselves by wearing a jersey color different from the jersey color of the first-string players. However, this method does not allow a particular scout team player to be identified as representing a particular player on the opposing team according to jersey number.

Additionally, many players, especially younger players, often do not properly don practice jerseys over pads that are typically worn under jerseys. For instance, a player will sometimes simply drape a practice jersey over his head to differentiate scout team from first-string players. Another method for differentiating the scout team players from first-team players is for the scout team players to wear markers or skullcaps on each of their helmets. However, it is often difficult to keep the skullcaps on the helmets during practice. Thus, currently utilized methods of differentiating scout team players from first-string players during practice are not effective.

Accordingly, there is a need in the art for an improved method for athletic coaching that allows a scout team to more simply and realistically emulate an opposing team's players during practice. In addition, there is a need in the art for a system and method for using practice jerseys for coaching a sports team.

SUMMARY

In one aspect, a method of coaching a sports team utilizing an athletic jersey system is provided. The present method is particularly advantageous for coaching football, but may be used in other sports, such as basketball, hockey, soccer, lacrosse, or rugby. The method utilizes an athletic jersey system in which number panels may be removably secured to jerseys, preferably to both the front and to the back of each jersey utilized. Each player on a scout team wears a jersey having a number panel showing a number that is worn by a player on an opposing team so that each individual scout team player represents a respective individual player on the opposing team. The jersey system showing scout team players with numbers corresponding to players on an opposing team allows first-string players, as well as coaches, to visually identify individual scout team players by jersey number without specifically alerting first-string team players which opposing team player is represented by which scout team player. This allows coaches to simulate real-time game conditions during practice. The jersey system also allows scout team players to change numbers as necessary to represent different opposing players as the opposing team changes from game to game. This feature allows a team to use a set of designated jerseys of different sizes to fit each individual scout team player, while also allowing each scout team player to change jersey number as necessary to practice for an opposing team from game to game.

To utilize the present method, players on a sports team are first separated into two subsets: a first-string team and a scout team. Each subset comprises a plurality of players, with each scout team player representing an individual player on an opposing team. Each scout team player dons a jersey having a securing element configured to removably secure a number panel thereto. Each scout team player then secures a number panel to his jersey. Preferably, each player secures a number panel to both the front and to the back of his jersey. Each number panel displays a number corresponding to an individual player on the opposing team to indicate which opposing player is represented by each respective player on the scout team.

Once the scout team players are each wearing a jersey with the number of the individual player on the opposing team that is being represented, the scout team players may get into a formation that simulates a formation used by an opposing team based on scouting reports and/or game tape of the opposing team. The first-string players may then practice identifying players on the scout team (and thus the player on the opposing team that the scout team player represents) by visually identifying the number on the number panel secured to the jersey worn by the scout team player. Depending on the play being practiced, the scout team may simulate the opposing team's offense or defense. A play may then be run with the scout team opposing the first-string team. After a game against an opposing team has been played, each scout team player can wear the same jersey for a new practice session but change the number on the jersey to match the number of an opposing player for the next game being played by the team against a new opponent.

In addition to identifying individual opposing players, the first-string team players can also practice identifying formations and personnel groupings utilized by the opposing team. The scout team players may change formations and/or personnel groupings on different plays during a practice session, but the number of each scout team player will remain the same. Thus, players on the first-string team can practice recognizing different formations, as well as different personnel groupings, whether a particular personnel grouping uses the same or a different formation as compared to a different personnel grouping.

The present method additionally allows coaches to practice recognizing formations and personnel groupings utilized by the opposing team in a practice setting. For instance, a coach practicing calling plays can identify the numbers of the scout team players running onto the field for a specific play during practice. Because each of the players will be wearing the specific number of an upcoming opposing team player, the coach will be able to practice recognizing various formations and/or personnel groupings prior to game time.

Additionally, the present method may allow first-string team players to practice recognizing player eligibility. For instance, in football, the number on a player's jersey generally indicates whether the player is an eligible receiver. Thus, the number a scout team player is wearing will indicate to first-string team players whether the scout team player is an eligible receiver. As such, the first-string players can practice making fast decisions regarding how to react to the opposing player based solely on jersey number.

The present method may also make practice sessions more efficient. When practicing, a scout team player will be assigned to emulate a specific player on the upcoming opposing team. Each scout team player will wear the number of the player they are emulating. As such, it is not necessary to repetitively assign scout team players to certain positions. For instance, a coach can hold up a placard showing a play of the opposing team, and the play will show each of the numbers for each player. The scout team players emulating the opposing players having each respective number will then know their respective position for that play. In addition, if a coach wants a particular scout team player to change which player on the opposing team that scout team player represents, the scout team player can quickly change the number of his jersey by switching number panels without the necessity of changing jerseys.

To facilitate securing a number panel to and removing a number panel from a jersey, each jersey comprises a securing element configured to removably secure a number panel thereto, and each number panel is configured to removably secure the number panel to the securing element of a jersey. In a preferred embodiment, the securing element of the jersey comprises a hook and loop fastener (e.g., "Velcro"), and each number panel has a corresponding hook and loop fastener attached to a rear side of the number panel. Each jersey preferably has a securing element located on both the front side of the jersey and the back side of the jersey. Thus, a single jersey may be used to display any desired number on both the front and on the back of the jersey.

Additionally, in a preferred embodiment, each jersey comprises a flap that covers a top edge of a number panel when the number panel is secured to the jersey. The flap prevents the number panel from being unintentionally ripped off of a jersey by another player. This feature is particularly advantageous in contact sports, such as football, in which players attempt to tackle other players, which may involve grabbing and pulling a player's jersey during the act of tackling.

Accordingly, one object of the present invention is to provide an improved method of athletic coaching utilizing an athletic jersey system. Another object of the present invention is to provide an athletic jersey system used for practicing in accordance with the proposed method.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "removably secured" and grammatical equivalents thereof are used herein to mean the joining of two components in a manner such that the two components are secured together, but may be detached from one another and re-secured together without requiring the use of specialized tools. As used herein, a "personnel grouping" refers to any specific group of players identifiable by jersey number. For instance, in football there are eleven players on offense and on defense on any given play. A personnel grouping may refer to any group of eleven specific players on offense or on defense, or any subset thereof, such as a group of offensive lineman or a group of wide receivers.

Figure 2:
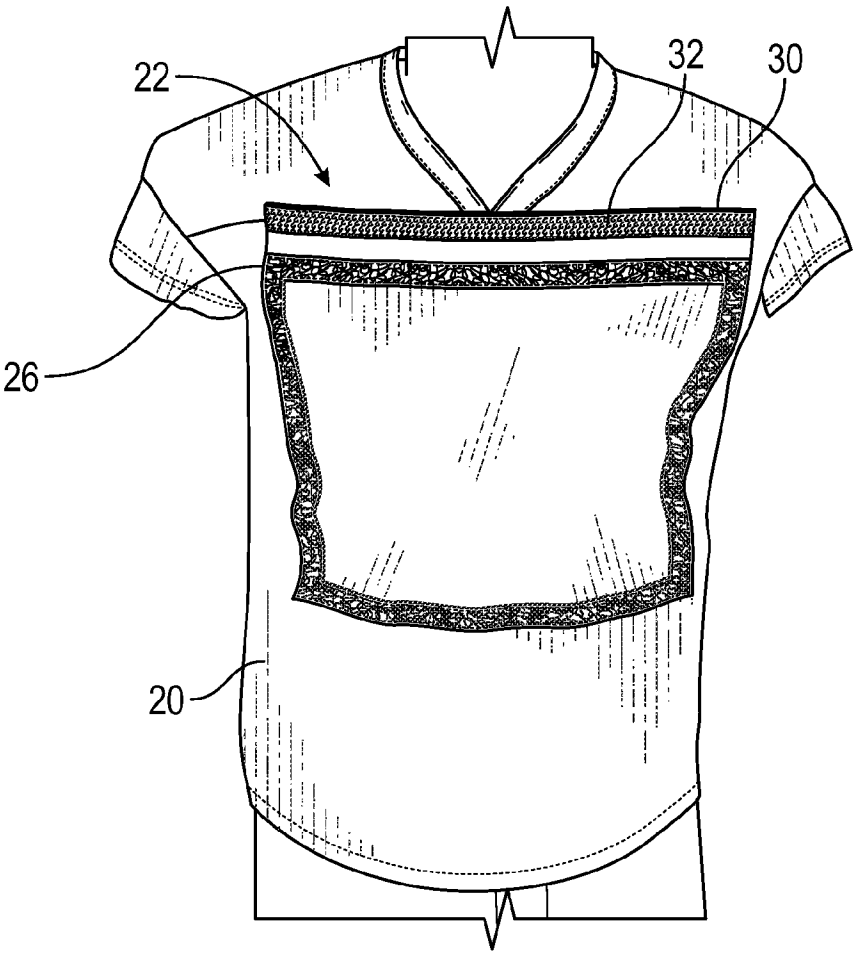
FIG. 2 shows a front view of a jersey being worn by a player without a number panel secured thereto in accordance with the present disclosure.
Figure 1:
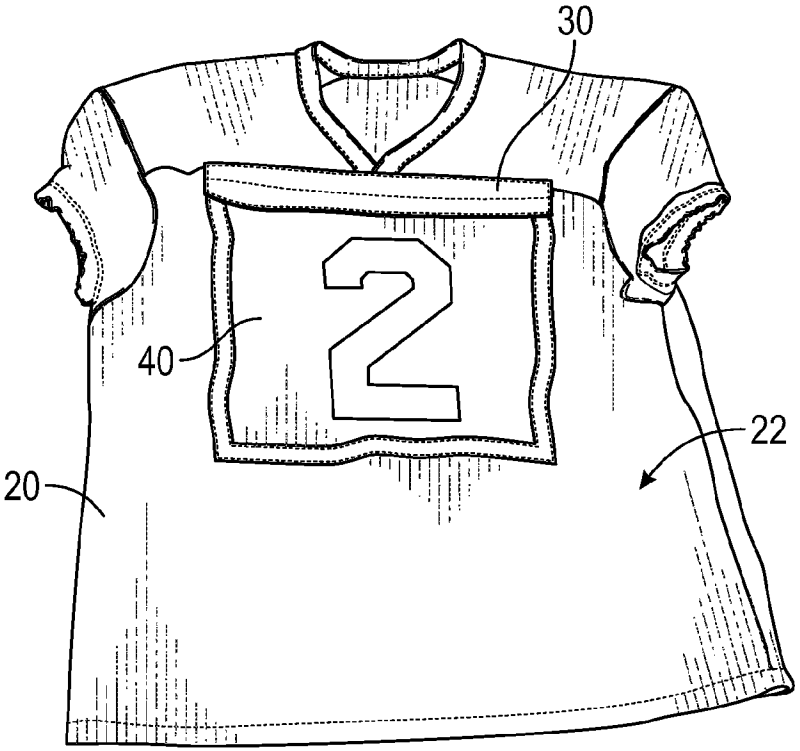
FIG. 1 shows a front elevational view of a jersey with a number panel secured thereto in accordance with the present disclosure.
Figure 4:
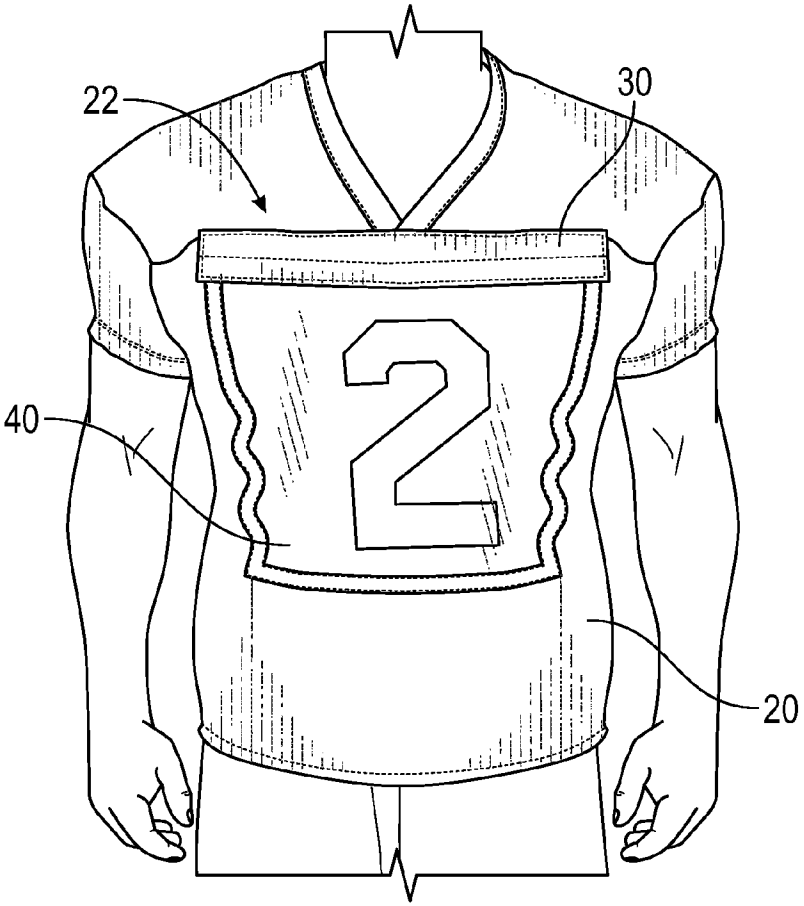
FIG. 4 shows a front view of a jersey being worn by a player with a number panel secured thereto in accordance with the present disclosure.
Figure 3:
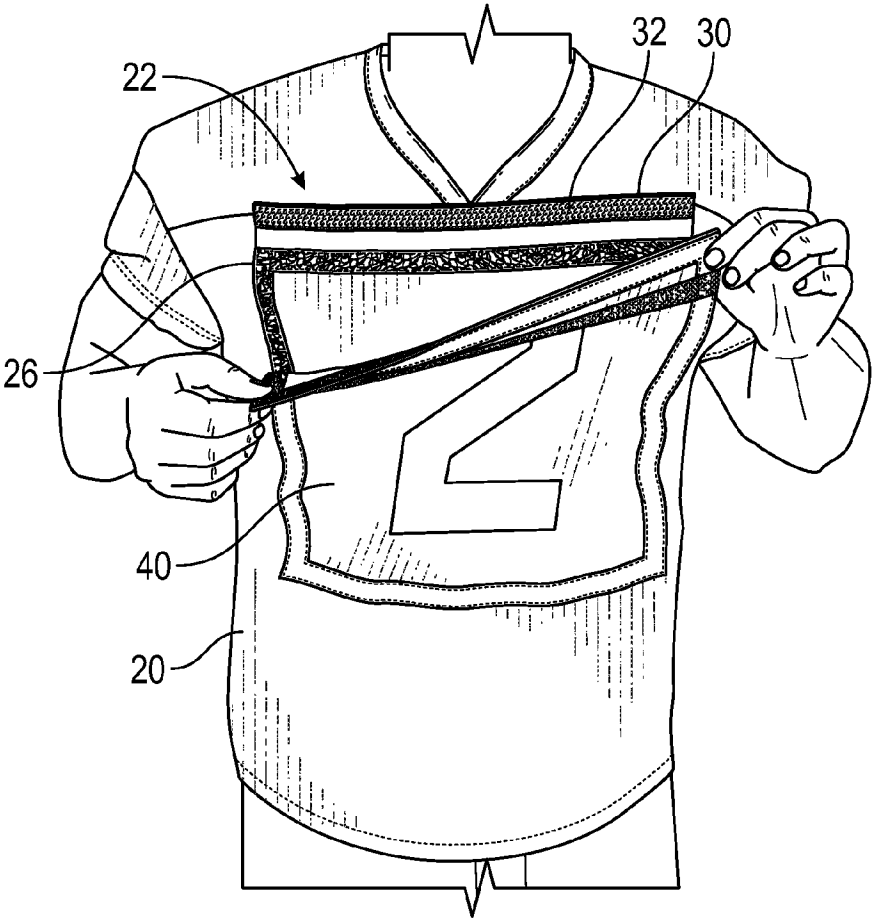
FIG. 3 shows a front view of a jersey worn by a player with a number panel being secured thereto in accordance with the present disclosure.
Figure 6:
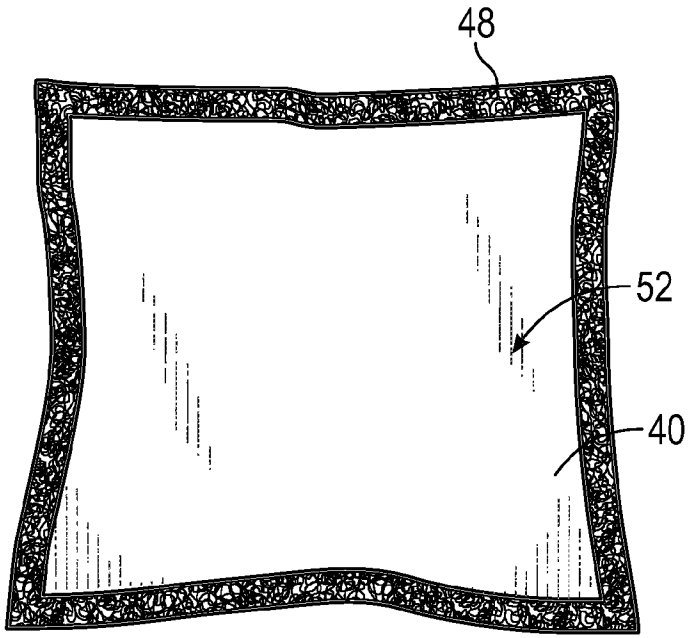
FIG. 6 shows a rear side of a detached number panel that may be utilized in accordance with the present disclosure.
Figure 5:
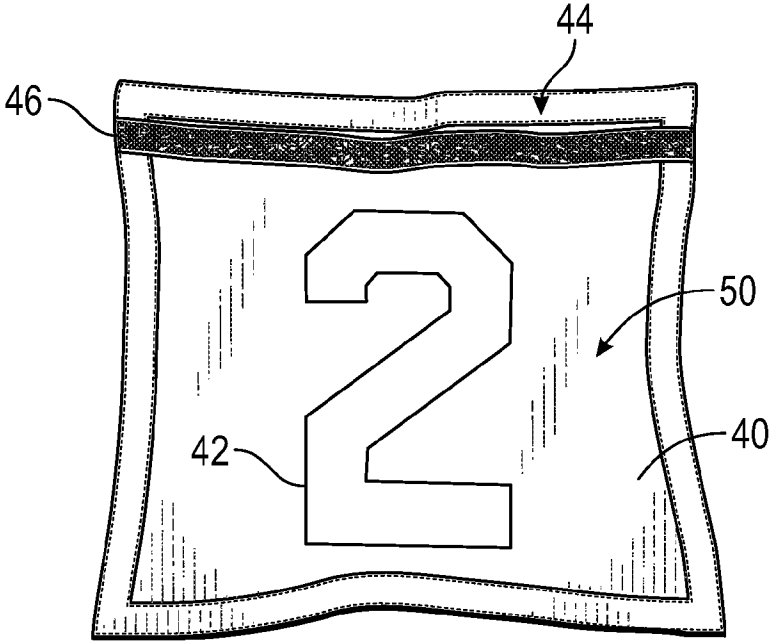
FIG. 5 shows a front side of a detached number panel that may be utilized in accordance with the present disclosure.

In one aspect, a method of coaching a sports team utilizing an athletic jersey system is provided. The present method is particularly advantageous for coaching football, but may be used in other sports, such as basketball, hockey, soccer, lacrosse, or rugby. The method utilizes an athletic jersey system in which number panels may be removably secured to jerseys, preferably to both the front and to the back of each jersey utilized. FIG. 1 illustrates a jersey 20 with a number panel 40 secured to the jersey, and FIG. 2 illustrates a jersey 20 with the number panel 40 removed from the jersey. FIG. 3 illustrates a player in the process of securing a number panel 40 to his jersey 20, and FIG. 4 illustrates the number panel 40 fully secured the jersey 20 so that the player may begin practicing with the jersey 20. FIGS. 5 and 6 illustrate a front side 50 and a rear side 52, respectively, of a number panel 40 that may be utilized with the present jersey system. In the present illustrations, the number panel 40 displays the number "2". However, it should be understood that any desired number 42 may be displayed on the front side 50 of the number panel 40. Each number panel 40 is preferably made of a flexible material such as cloth and may be made of the same material as the jersey 20.

Each jersey 20 comprises a securing element 26 configured to removably secure a number panel 40 thereto. In addition, each number panel 40 is configured to removably secure the number panel 40 to the securing element 26 of a jersey 20. In a preferred embodiment, as best seen in FIG. 2, the securing element 26 is a hook and loop fastener, and the rear side 52 of the number panel 40 has a corresponding hook and loop fastener 48 attached thereto, as seen in FIG. 6. Thus, in a preferred embodiment, the number panel 40 may be secured to the jersey 20 by securing two compatible sections of hook and loop fasteners to each other. To ensure that the number panel 40 is adequately secured to the jersey 20, the hook and loop fastener 48 on the rear side 52 of the number panel 40 preferably comprises one or more strips of fastener that generally extends around the entire perimeter of the number panel 40, as shown in FIG. 6. Similarly, the hook and loop fastener 26 on the jersey 20 preferably comprises one or more strips arranged in the same general pattern and shape of those attached to the number panel 40 such that the sections of compatible hook and loop fasteners may contact each other generally around the entire perimeter of the number panel 40.

In alternative embodiments, the securing element 26 may comprise any suitable securing means known in the art. For instance, the securing element 26 may comprise one component of a zipper, and the number panel 40 may have a compatible zipper component attached thereto. In another example, the securing element 26 may comprise a magnet, and the number panel 40 may have a corresponding magnet or thin piece of metal material attached thereto such that the number panel 40 may be secured to the jersey 20 via magnet. Other suitable securing elements 26 may comprise clips, buckles, or similar securing means known in the art. In another alternative embodiment, the securing element 26 may comprise a pocket on the exterior of the jersey 20 made of a clear, flexible plastic material, and the number panel 40 may be made of a semi-rigid, bendable material that can be inserted into the pocket such that the number 42 is visible through the clear pocket.

In a preferred embodiment, the jersey 20 further comprises a flap 30 configured to cover a top edge 44 of a number panel 40 when the number panel is secured to the jersey, as best seen in FIG. 4. To cover the top edge 44 of the number panel 40, the flap 30 is positioned to run along the top edge 44 of the number panel 40 and sized such that the flap 30 covers the top edge 44 of the number panel 40 when the flap 30 is folded downward and the number panel 40 is secured to the jersey 20. In addition, the flap 30 is preferably configured to secure the flap 30 to the number panel 40 in a position covering the top edge 44 of the number panel 40. In a preferred embodiment, to secure the flap 30 in the position shown in FIG. 4, an inside portion of the flap 30 has a hook and loop fastener 32 attached thereto, as seen in FIGS. 2 and 3, which show the flap 30 lifted up. In addition, a front side 50 of the number panel 40 preferably has a corresponding hook and loop fastener 46 attached thereto, as shown in FIG. 5. Thus, the flap 30 may be secured to the front side 50 of the number panel 40 such that the top edge 44 of the number panel is covered by fastening the hook and loop fastener 32 attached to the inside portion of the flap 30 to the hook and loop fastener 46 attached to the front side 50 of the number panel 40 after securing the number panel 40 to the jersey 20. When covering the top edge 44 of the number panel 40, the flap 30 prevents the number panel 40 from being unintentionally ripped off of a jersey 20 by another player. This feature is particularly advantageous in contact sports, such as football, in which players attempt to tackle other players, which may involve grabbing and pulling a player's jersey during the act of tackling.

Figure 8:
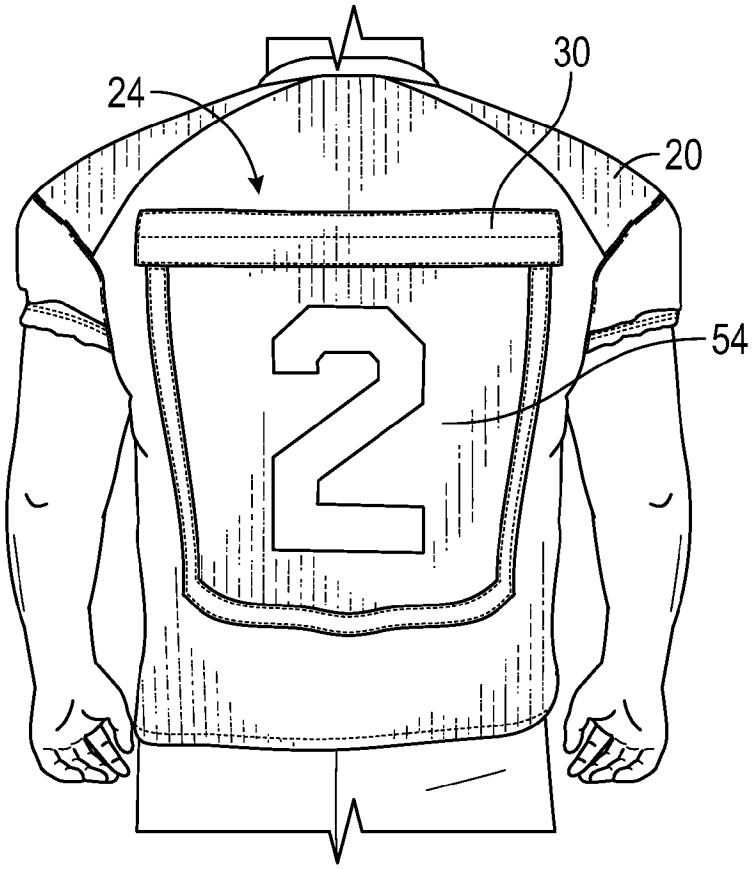
FIG. 8 shows a back view of a jersey being worn by a player with a number panel secured thereto in accordance with the present disclosure.
Figure 7:
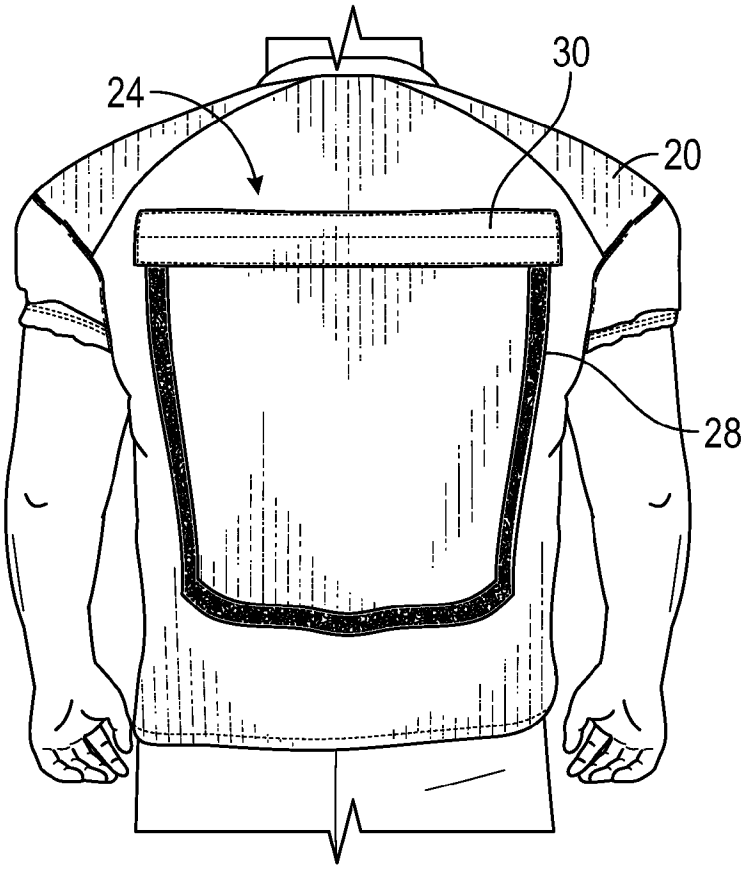
FIG. 7 shows a back view of a jersey being worn by a player without a number panel secured thereto in accordance with the present disclosure.

As shown in FIG. 4, the jersey 20 has at least one number panel 40 secured to a front side 22 of the jersey 20 for use during practice. In a preferred embodiment, as shown in FIG. 7, each jersey further comprises a second securing element 28 located on a back side 24 of the jersey 20. The optional second securing element 28 may be used to secure a second number panel 54 to the back side 24 of the jersey 20, as shown in FIG. 8. The jersey 20 preferably has a second flap 30 on the back side 24 to cover the top edge 44 of the second number panel 54 when secured to the jersey. The second number panel 54 preferably displays the same number 42 as the number panel 40 on the front of the jersey 20 and allows a scout team player to be identified by visually observing the back side 24 of the player's jersey in instances where the scout team player is positioned with his back facing an observer.

To practice utilizing the jersey system described above, each player on a scout team wears a jersey 20 having a number panel 40 showing a number 42 that matches the number worn by a player on an opposing team so that each individual scout team player represents a respective individual player on the opposing team. The jersey system showing scout team players with numbers corresponding to players on an opposing team allows first-string players, as well as coaches, to visually identify individual scout team players by number 42 without specifically alerting first-string team players which opposing team player is represented by which scout team player. This allows coaches to simulate real-time game conditions during practice. The jersey system also allows scout team players to change numbers 42 as necessary to represent different opposing players as the opposing team changes from game to game. This feature allows a team to use a set of designated jerseys of different sizes to fit each individual scout team player, while also allowing each scout team player to change jersey number 42 as necessary to practice for an opposing team from game to game.

To utilize the present method to coach a sports team, players on a sports team are first separated into two subsets: a first-string team and a scout team. Each subset comprises a plurality of players, with each scout team player representing an individual player on an opposing team. Each scout team player is provided a jersey 20 having a securing element 26 configured to removably secure a number panel 40 thereto. Each scout team player is also provided a number panel 40 to secure to his jersey 20. The number panel 40 displays a designated number 42 assigned to each individual scout team player. Players on the scout team each don a jersey 20 and secure a number panel 40 to the jersey 20. The number panel 40 may be secured to the jersey 20 before or after donning the jersey 20. Preferably, each jersey 20 has a second securing element 28 on the back of the jersey, and each player secures a number panel 40 to the front of the jersey and a second number panel 54 to the back of the jersey. The number panels 40, 54 used for each individual scout team player shows displays the same number 42, which corresponds to an individual player on the opposing team to indicate which opposing player is represented by each respective player on the scout team. Each scout team player will have a different jersey number 42 than the other scout team players. The securing elements 26, 28 preferably comprise hook and loop fastener so that the number panels 40, 54 may be secured to the jersey 20 by fastening corresponding hook and loop fasteners attached to the rear side of each number panel to the hook and loop fasteners 26, 28 on the jersey. The number panels may also be detached from the jersey by separating the corresponding hook and loop fasteners so that the number panels may be changed as necessary.

Once the scout team players are each wearing a jersey 20 with the number 42 of the individual player on the opposing team that is being represented, the scout team players may get into a formation that simulates a formation used by an opposing team based on scouting reports and/or game tape of the opposing team. The first-string players may then practice identifying players on the scout team (and thus the player on the opposing team that the scout team player represents) by visually identifying the number 42 on the number panel 40 or 54 secured to the jersey 20 worn by the scout team player. Depending on the play being practiced, the scout team may simulate the opposing team's offense or defense. A play may then be run with the scout team opposing the first-string team.

In addition to identifying individual opposing players, the first-string team players can also practice identifying formations and personnel groupings utilized by the opposing team. The scout team players may change formations and/or personnel groupings on different plays during a practice session, but the number 42 of each scout team player will remain the same during that practice session. Thus, players on the first-string team can practice recognizing different formations, as well as different personnel groupings, whether a particular personnel grouping uses the same or a different formation as compared to a different personnel grouping.

FIGS. 10-14 show diagrams of various football plays to illustrate the method disclosed herein. For ease of illustration, FIGS. 10-14 show only the offensive players on the diagrammed plays. It should be understood that defensive players, though not shown in the figures, will be lined up across a line of scrimmage from the offensive players when practicing plays or in a game situation. In the following examples, the scout team players are playing on offense, and the first-string team players are playing on defense. Thus, for ease of illustration, FIGS. 10-14 show only the scout team players on the diagrammed plays. In other examples, the scout team players may play on defense, and the first-string team players may play on offense. As shown in FIGS. 10-14, the numbers shown in the figures represent the numbers 42 on the jerseys 20 of the scout team players. The number "61" shown in a square in each figure represents the center position on an offensive line.

Figure 10:
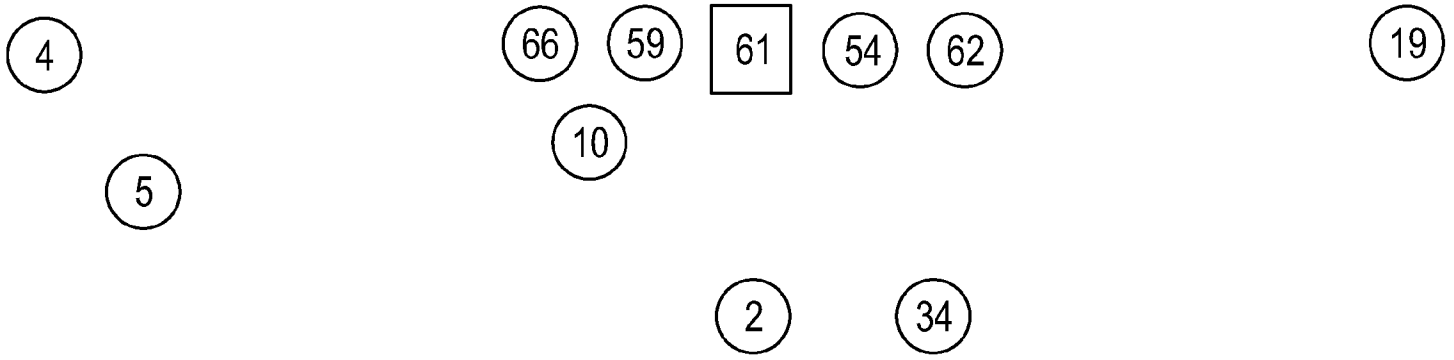
FIG. 10 shows an illustrative diagram of a football play that may be practiced using a jersey in accordance with the present disclosure.
Figure 11:
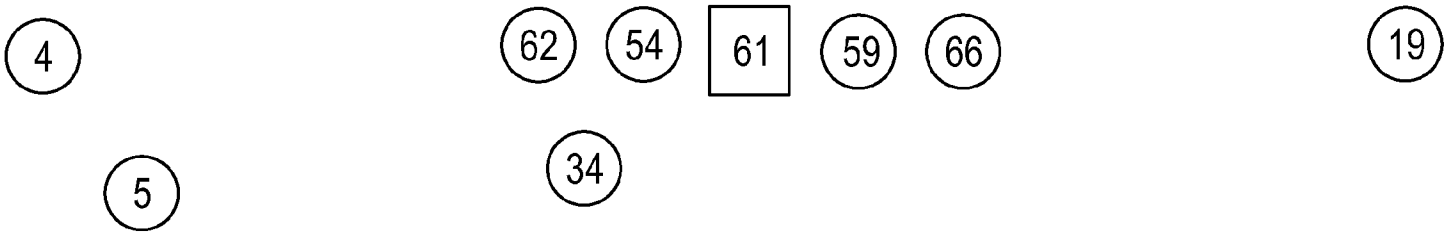
FIG. 11 shows an illustrative diagram of a football play that may be practiced using a jersey in accordance with the present disclosure.

To illustrate the proposed method, FIGS. 10 and 11 illustrate two variations of a similar formation. When reviewing game film of an opposing team, a coach may notice trends in the opposing team's play call based on formations and/or personnel groupings. For instance, a coach may notice that when player number "66", "59", and "10" line up as shown in FIG. 10, these particular players in this formation will likely result in a running play in which player number "10" runs the ball behind player number "66" and "59". In contrast, the coach may notice that when player number "62", "54", and "34" line up as shown in FIG. 11, these particular players in this formation is unlikely to result in a running play in which player number "34" runs the ball behind player number "62" and "54", though the portion of each formation on the left side of the line of scrimmage may appear to be similar in the formations shown in both FIGS. 10 and 11. However, the coach may notice that when these particular players line up in the formation shown in FIG. 11, the likely play call is the quarterback (player number "2") passing the ball to player number "19", a wide receiver.

A comparison of the formations of the players on the scout team as shown in FIGS. 10 and 11 shows two offensive guards (player number "54" and "59"), two offensive tackles (player number "62" and "66"), a center (player number "61"), and a back (player number "10" in FIG. 10 and player number "34" in FIG. 11) behind the left guard and left tackle. As such, the formations shown in FIGS. 10 and 11 are very similar. Thus, it would be very difficult, based on formation alone, for the first-string players to identify which opposing players are being emulated by the scout team players, and thus what play the first-string players should be anticipating, in the absence of jersey numbers 42 on the jerseys 20 of the scout team players. In addition, if the first-string players cannot identify opposing players by jersey number, it is not possible for the first-string players to identify a personnel grouping being presented, based on formation alone.

However, by utilizing jerseys 20 each having a designated number 42 corresponding to an individual opposing player and assigned to each individual scout team player, the first-string team players may practice identifying personnel and personnel groupings based not only on formation, but also based on the jersey numbers 42 of each of the scout team players. This allows a coach to more realistically simulate a game so that the first-string players are better prepared for the upcoming opponent. When the time comes to practice for a new opponent, the scout team can use the same jerseys 20 but with different numbers 42 as desired by the coach in order to simulate a game against the new opponent having starting players who wear different jersey numbers than those of the previous opponent. Thus, the present system and method allow a team to realistically simulate games against any opponent using the same set of scout team jerseys 20 by switching the jersey numbers 42 on the jerseys.

Figure 12:
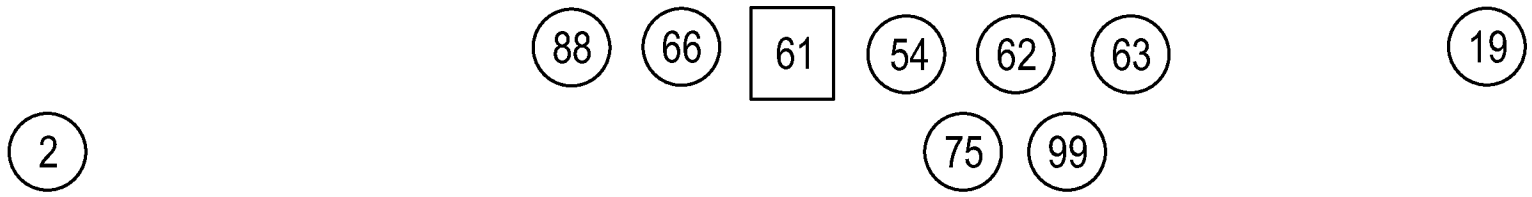
FIG. 12 shows an illustrative diagram of a football play that may be practiced using a jersey in accordance with the present disclosure.
Figure 13:
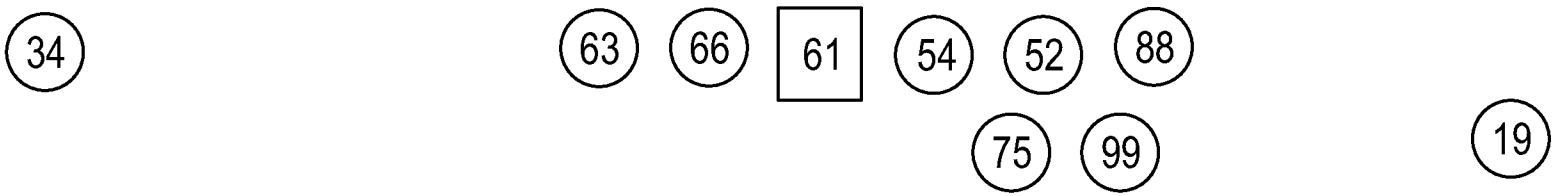
FIG. 13 shows an illustrative diagram of a football play that may be practiced using a jersey in accordance with the present disclosure.

Another example of how the method may be utilized can be seen by comparing FIGS. 12 and 13. Both FIGS. 12 and 13 show a center, two offensive guards, two offensive tackles, and a tight end on the right side (player number "63" in FIG. 12 and player number "88" in FIG. 13). Behind these players, both FIGS. 12 and 13 show two players (player number "75" and "99") on the right side behind the guard, tackle, and tight end. Additionally, both FIGS. 12 and 13 show another player in the backfield behind the center (player number "34" in FIG. 12 and player number "2" in FIG. 13). Without numbers 42 on the scout team player jerseys 20, these two plays may appear to be nearly identical plays based on formation alone. As such, it may be difficult for first-string players to anticipate the play call when the opposing team lines up in this formation if the first-string players cannot identify which scout team player is emulating which player on the opposing team. However, utilizing jersey numbers 42 on the scout team player jerseys 20 allows the first-string players to recognize that these are two different plays since the scout team players are lined up in different positions, though the overall formation may be nearly identical in each play. Thus, first-string team players can practice recognizing these two different plays by identifying positions where specific scout team players are lining up based on visual identification of jersey numbers 42. This allows first-string players to practice recognizing player packages and plays featuring a variety of different players on the opposing team lined up in a variety of formations. In addition, repetitive practicing against scout team players using opposing player jersey numbers helps players remember opposing player jersey numbers in preparation for an upcoming game.

The present method may also assist in coaching players regarding recognizing player eligibility. Generally, eligible players in football are players who may act as receivers. Eligible football players generally wear jersey numbers in the range of "1" through "49" and "80" through "99". Knowing whether a specific player is eligible as a receiver is important because it is often a major consideration when determining how best to react to and defend that player. Utilizing the present method, the jersey number 42 worn by a scout team player will indicate to first-string players whether the scout team player is an eligible receiver. As such, first-string players can practice making fast decisions regarding how to react to a specific player based solely on jersey number.

Figure 14:
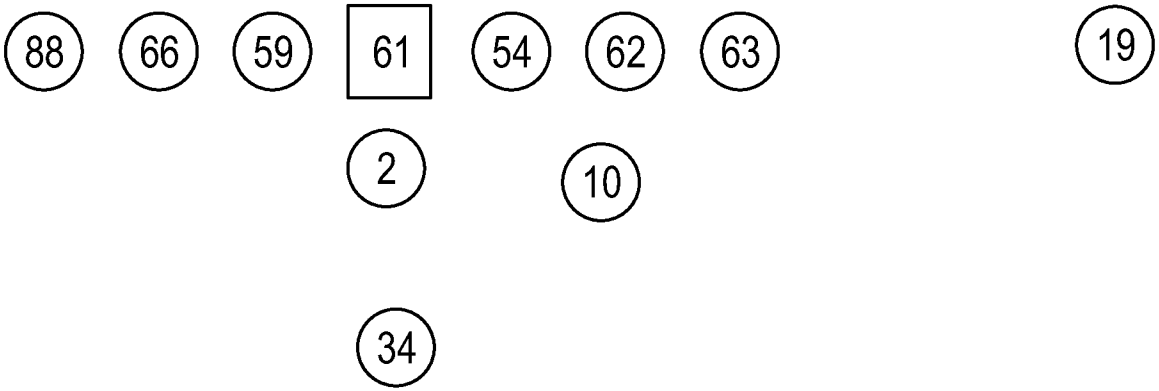
FIG. 14 shows an illustrative diagram of a football play that may be practiced using a jersey in accordance with the present disclosure.

For example, FIG. 14 illustrates a double tight end set. This formation is based on a center, two offensive tackles, two offensive guards, and a tight end on each end of the offensive line. As illustrated in FIG. 14, the right side tight end is number "63" and the left side tight end is number "88". Based on the jersey number 42 of each tight end, only number "88" is an eligible receiver. Thus, any first-string team player guarding either scout player lined up at the tight end position can recognize whether either of those two scout team players is an eligible receiver based solely on jersey number 42. Thus, the jersey number 42 may dictate to a first-string player how to react to a particular scout team player based on jersey number. If players "63" and "88" change sides, the first-string players must learn to recognize this personnel change and react accordingly.

The present method additionally allows coaches to practice recognizing formations and personnel groupings utilized by the opposing team in a practice setting. For instance, a coach practicing calling plays can identify the numbers 42 of the scout team players running onto the field for a specific play during practice. Because each of the players will be wearing the specific number 42 of an upcoming opposing team player, the coach will be able to practice recognizing various formations and/or personnel groupings prior to game time. In football, some coaches sit in a coaching box located in a stadium above the field during games and watch the opposing team to determine which players are being sent on to the field. The coach in the box will analyze the players going on to the field to determine which personnel grouping and/or play the opposing team is likely to present on a given play. In response to the opposing players going on to the field, the coach in the box can call a play and relay the play call down to the field to counter an anticipated play of the opposing team. Utilizing the present method, a coach practicing calling plays from the box will identify which scout team players are running onto the field for a specific play based on jersey number 42. Because each of the scout team players will be wearing the specific number 42 of an upcoming opposing team player, the coach will be able to practice recognizing various personnel groupings prior to game time. For instance, if a coach recognizes an opposing team's offensive personnel grouping (represented by the scout team with corresponding jersey numbers 42), the coach may adjust the defense by calling a specific defensive play with certain defensive players in order to counter an expected offensive play. The present system and method allow coaches to practice making quick personnel decisions by simulating in-game conditions.

The present method may also make practice sessions more efficient. When practicing, a scout team player will be assigned to emulate a specific player on the upcoming opposing team. Each scout team player will wear the jersey number 42 of the player they are emulating. As such, it is not necessary to repetitively assign scout players to certain positions. For instance, a coach can hold up a placard showing a play of the opposing team, and the play will show each of the numbers for each player. The scout team players emulating the opposing players having each respective number will then know their respective position for that play. In addition, if a coach wants a particular scout team player to change which player on the opposing team that scout team player represents, the scout team player can quickly change the number 42 of his jersey 20 by switching number panels 40 without the necessity of changing jerseys. In addition, after a game against an opposing team has been played, each scout team player can wear the same jersey 20 for a new practice session but change the number 42 on the jersey to match the number of an opposing player for the next game being played by the team against a new opponent.

Figure 9:
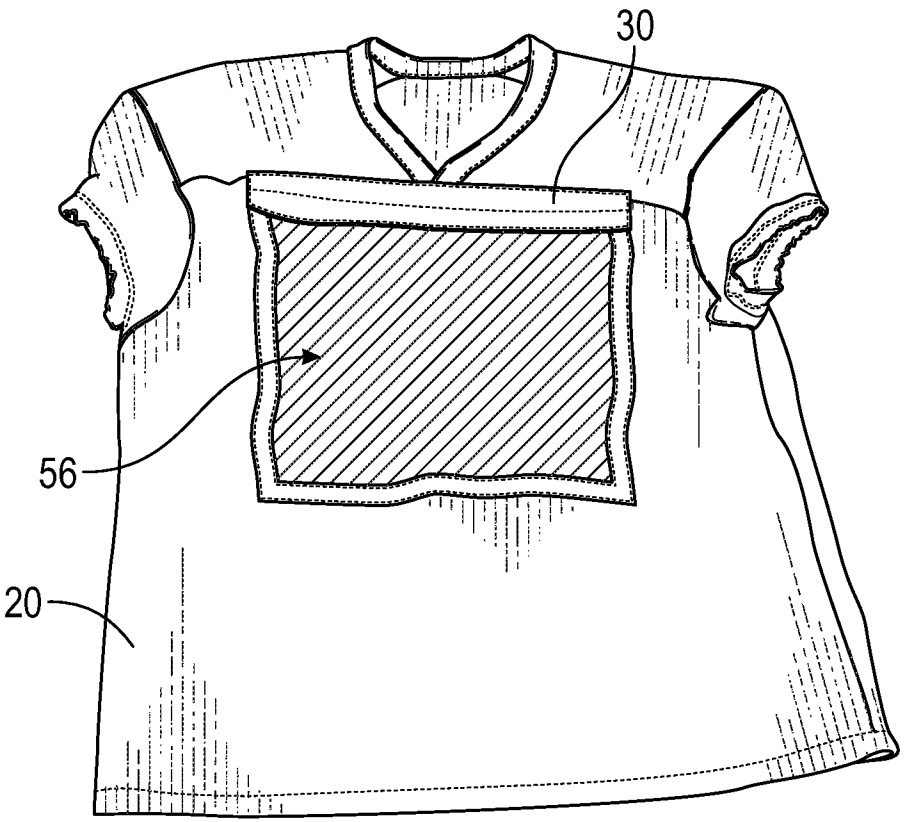
FIG. 9 shows a front elevational view of a jersey with a color panel secured thereto in accordance with the present disclosure.

In an alternative embodiment, as shown in FIG. 9, a color panel 56 may be secured to a jersey 20 instead of a number panel 40. The front of the color panel 56 is preferably substantially a solid color, but may have lines or other similar designs. In some instances, a coach may want scout team players to represent a specific unit of players without the necessity of each scout team player representing a specific opposing player. In such cases, a unit of scout team players may utilize jerseys 20 with color panels 56 all of the same color. One example of a unit of players that may utilize such color panels is a special teams unit of scout players practicing against a first-string special teams unit.

It is understood that versions of the invention may come in different forms and embodiments. Additionally, it is understood that one of skill in the art would appreciate these various forms and embodiments as falling within the scope of the invention as disclosed herein.

What is claimed is:

1. A method of coaching a sports team, said method comprising the steps of:

separating players on a sports team into two subsets: a first-string team and a scout team, wherein each subset comprises a plurality of players, wherein each respective player on the scout team represents an individual player on an opposing team;

providing a jersey to each player on the scout team, wherein each jersey comprises a securing element configured to removably secure a number panel thereto;

donning, by each player on the scout team, a respective jersey;

providing a number panel displaying a number thereon to each player on the scout team, wherein each number panel is configured to removably secure the number panel to the securing element of a jersey;

removably securing a respective number panel to each jersey of each player on the scout team, wherein the respective number displayed on each number panel corresponds to a jersey number worn by an individual player on an opposing team to indicate which individual player on the opposing team is represented by each respective player on the scout team; and running a play in which the scout team opposes the first-string team.

2. The method of claim 1, wherein the securing element of each jersey comprises a hook and loop fastener, wherein each number panel has a corresponding hook and loop fastener attached to a rear side of the number panel, and wherein the step of removably securing a respective number panel to each jersey comprises fastening the hook and loop fastener attached to the rear side of the number panel to the hook and loop fastener of the jersey.

3. The method of claim 1, wherein each jersey comprises a flap that covers a top edge of a number panel when the number panel is removably secured to the jersey, further comprising the step of covering the top edge of the number panel with the flap.

4. The method of claim 3, wherein the flap is configured to secure the flap to the number panel in a position covering the top edge of the number panel, further comprising the step of securing the flap to the number panel in a position covering the top edge of the number panel.

5. The method of claim 4, wherein an inside portion of the flap has a hook and loop fastener attached thereto, wherein each number panel has a corresponding hook and loop fastener attached to a front side of the number panel, and wherein the step of securing the flap to the number panel comprises fastening the hook and loop fastener attached to the inside portion of the flap to the hook and loop fastener attached to the front side of the number panel.

6. The method of claim 1, wherein the securing element of each jersey is located on a front side of the jersey, and wherein the step of removably securing a respective number panel to each jersey of each player on the scout team comprises removably securing the respective number panel to the front side of each jersey of each player on the scout team.

7. The method of claim 6, wherein each jersey further comprises a second securing element located on a back side of the jersey, wherein the method further comprises the step of removably securing a second number panel to the second securing element, wherein both number panels secured to the jersey have the same number thereon.

8. The method of claim 1, wherein the step of providing a jersey to each player on the scout team comprises selecting each jersey from the group consisting of: a football jersey, a basketball jersey, a hockey jersey, a soccer jersey, a lacrosse jersey, and a rugby jersey.

* * * * *